US005763808A

United States Patent [19]

Thomson

[11] Patent Number: 5,763,808

[45] Date of Patent: Jun. 9, 1998

[54] SWITCHING APPARATUS FOR ELECTRIC GUITAR PICKUPS

[76] Inventor: Patrick Geoffrey Thomson, 4 New Road, Esher, Surrey, England, KT10 9PG

[21] Appl. No.: 788,431

[22] Filed: Jan. 28, 1997

[30] Foreign Application Priority Data

Jan. 31, 1996 [GB] United Kingdom ..... 9601949

[51] Int. Cl.[6] ..... G10H 3/18

[52] U.S. Cl. ..... 84/728

[58] Field of Search ..... 84/726–728

[56] References Cited

U.S. PATENT DOCUMENTS 3,915,048 10/1975 Stich .

5,136,918 8/1992 Riboloff .

5,311,806 5/1994 Riboloff .

FOREIGN PATENT DOCUMENTS

WO92/13335 8/1992 WIPO .

*Primary Examiner*—Stanley J. Witkowski

*Attorney, Agent, or Firm*—Richard K. Robinson

[57] ABSTRACT

Switching apparatus for selection of pickup coils of an electric guitar having dual coil bridge humbucker pickups, dual coil fingerboard humbucker pickups and a single coil intermediate pickup. The apparatus comprises a four-gang three-way switch and a two-gang five-way switch interconnected so that the guitarist may control which combinations of pickups operate at any one time thereby providing the tonal characteristics of a STRATOCASTER, a LES PAUL or a "coil tapped" LES PAUL guitar optional "out of phase" tonalities.

8 Claims, 2 Drawing Sheets

SWITCHING APPARATUS FOR ELECTRIC GUITAR PICKUPS

The invention generally relates to electric guitars and more particularly to improved switching apparatus for the provision of a variable tone electric guitar. Different tonal modes are selected by means of switching apparatus that determines which combinations of electric pickups on the guitar are connected at any one time. In this way the guitar is able to produce the variety of tonal characteristics which might otherwise be provided by using more than one guitar.

BACKGROUND OF THE INVENTION

Electric guitars as known in the state of the art predominantly operate to provide one of two characteristic tonal sounds which are determined by the selected arrangement of pickups on the main body of the guitar positioned beneath the strings. One of these tones is provided when three single coil pickups are utilised. This is the so-called Fender tonality of the STRATOCASTER guitar. The other prominant tone is obtained when two dual coil hum-cancelling (or humbucking) pickups are utilised. This is the so-called Gibson tonality of the LES PAUL guitar. A LES PAUL guitar may be coil tapped so that only one coil of each hum cancelling pickup is used.

Attempts have been made in the past to produce a single guitar which can alone provide the characteristic sounds provided by both these variants. These attempts utilise multi-pickup guitars arranged so that the particular pickups which are connected at any one time are selected by switching apparatus. One such guitar is disclosed in U.S. Pat. No. 5,136,918.

It is one object of the present invention to provide an improved switching apparatus for the selection of pickup coils mounted on an electric guitar which makes possible a guitar which can provide additional tonalities.

SUMMARY OF THE INVENTION

The present invention provides an electric guitar comprising a dual coil bridge humbucker pickup, a dual coil fingerboard humbucker pickup, an intermediate pickup located between said bridge and fingerboard pickup, and switching apparatus having an output terminal and selection circuitry to selectively connect one or more coils of said pickups to the output terminal thereby selecting the tonal characteristics of the guitar when played, wherein said selection circuitry is operable to connect selectively one or more coils of said pickups to said output terminal to provide the tonal characteristics of a STRATOCASTER, or a LES PAUL guitar, and wherein the selection circuitry is operable to alter the direction of connection of the coils of at least one dual coil pickup in order to provide "in phase" and "out of phase" tonal characteristics.

Preferably the selection circuitry of the electric guitar is operable to connect one or more coils from the selection of (1) one coil alone comprising either of the bridge pickup coils, the intermediate pickup coil or one of the fingerboard pickup coils, (2) both coils of one dual coil pickup, (3) both coils of both dual coil pickups, (4) the intermediate pickup with one coil of either of said dual coil pickups, and (5) one coil from each of the two dual coils.

Embodiments of the invention may provide a guitar pickup switching apparatus which whilst providing these additional tonalities remains suitably simple to use so that the change in tonalities may be effected relatively simply during a performance.

DESCRIPTION OF THE PREFERRED EMBODIMENT

Figure 1:
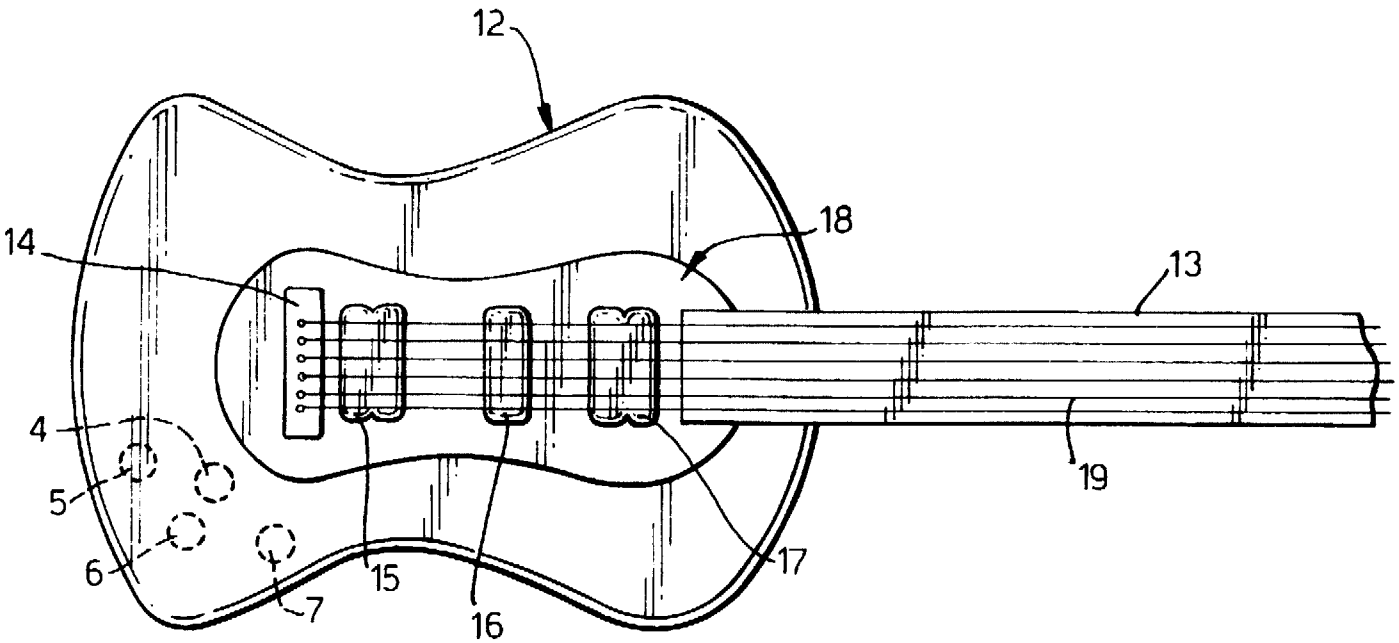
FIG. 1 is a plan view of a guitar body.

With reference to FIG. 1 a guitar 11 is shown consisting of a neck 13 connected to a main body 12 upon which is attached a scratch plate 18. The strings 19 are connected at one end to the neck of the guitar (not shown) and at the other to the bridge 14. Dual coil hum cancelling (humbucker) pickups 15 are arranged near the bridge and secured transversely beneath the strings to the scratch plate. They are known as the bridge pickups. A second set of humbucker pickups 17 are arranged beneath the strings in a spaced apart substantially parallel arrangement with the bridge pickups. This second set of pickups are positioned adjacent one end of the neck and are called the fingerboard pickups. A single coil pickup 16 is secured to the scratch plate in a position substantially parallel to and intermediate the two humbucker pickups. Each of the humbucker pickups consists of two coils which are wound in different senses to each other. In this way any signal noise (or hum) caused by a local mangnetic field inducing a current in the coils is substantially reduced.

Figure 2:
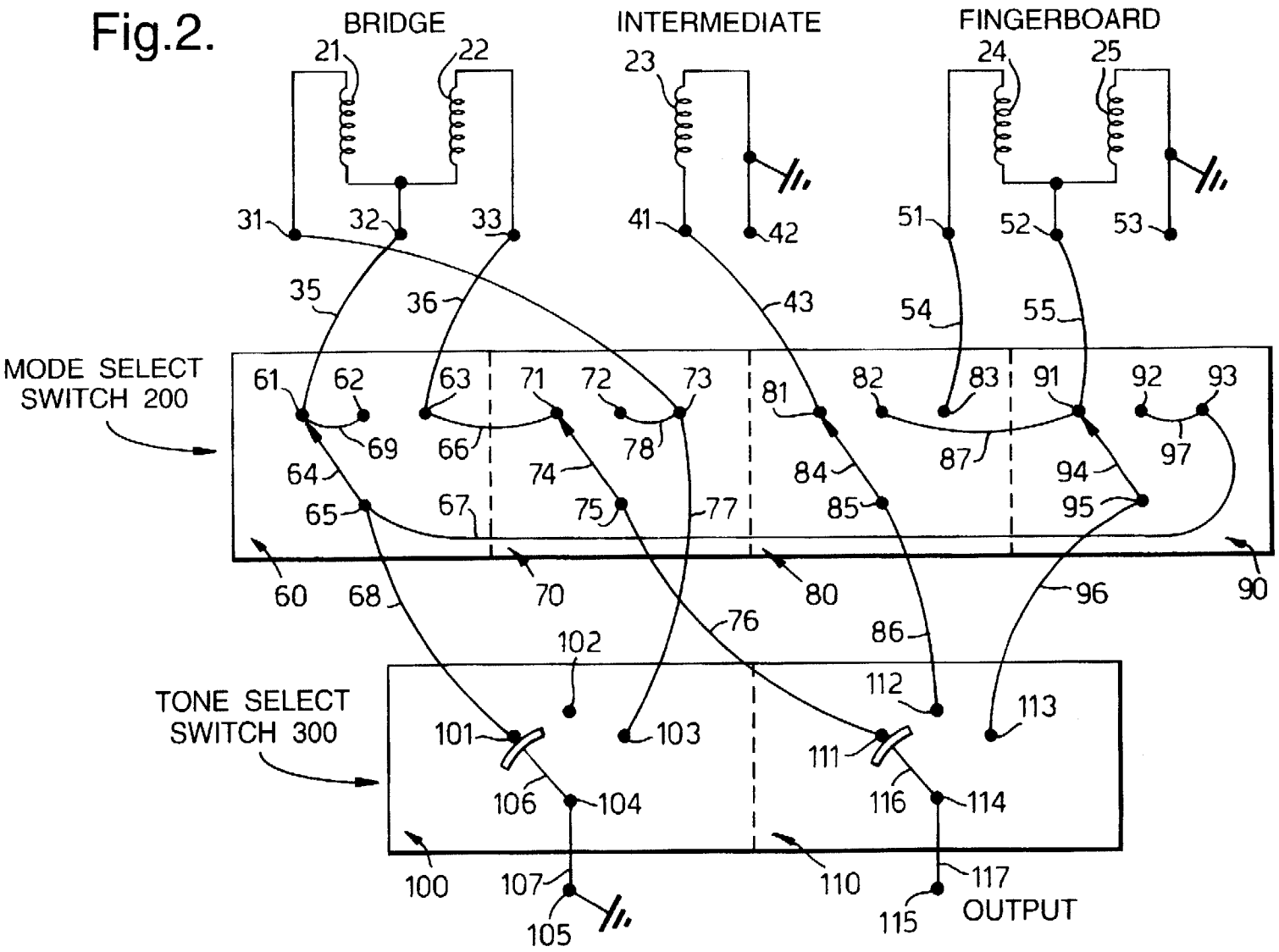
FIG. 2 is a schematic diagram of the switching apparatus according to the present invention.

In order to provide the required variety of tonal characteristics as described above the various pickups are connected according to the switching apparatus as shown in FIG. 2. The switching apparatus comprises lead connections to the various guitar pickup coils attached to the guitar and two multi-gang multiposition switches 200 and 300 as hereinafter described that select which pickup coils are connected at any one time. The apparatus is normally mounted within the main body 12 of the guitar 11 with two external switch control members 6 and 7 typically mounted externally, upon the guitar body, in the positions shown in FIG. 1. Each one of the two external switch control members 6 and 7 is associated with a respective one of switches 200 and 300 so that the setting of switches 200 and 300 may be controlled relatively simply by the guitarist whenever desired.

FIG. 2 shows the two bridge humbucker pickup coils 21 and 22 and the two fingerboard humbucker pickups coils 24 and 25. Bridge pickup coils 21 and 22 are wound in opposite senses to each other as are fingerboard pickup coils 24 and 25. In addition in this example bridge pickup 21 is wound in the same sense as fingerboard pickup 24 whilst pickups 22 and 25 are wound in the same sense opposite that of coils 21 and 24. One end of coil 21 is connected to terminal 31 whilst the other end is joined at a common terminal 32 to one end of coil 22. The other end of coil 22 is connected to terminal 33. The coils of fingerboard coils 24 and 25 are likewise connected with terminals 51, 52 and 53 corresponding to terminals 31, 32 and 33 of the bridge coils. One end of coil 23 is connected to ground at terminal 42. The other end is connected to terminal 41.

Switch 200 is a four-gang three-way switch and is used to select in which mode the guitar operates such that a first, second or third set of five tonality signals may be selected by switch 300. The first gang 60 of switch 200 has a first set of three terminals 61, 62 and 63, one of which may be selected at any one time. Terminal 61 is connected by lead 35 to the common terminal 32 between the two bridge coils 21 and 22 and also by lead 69 to terminal 62. Terminal 63 is connected to the end terminal 33 of coil 22 by lead 36. The second gang 70 of switch 200 has a set of three terminals 71, 72 and 73, any one of which may be selected at any one time. Terminal 71 is connected by lead 66 to terminal 63 of the first set of terminals in the first gang 60. Terminals 72 and 73 are connected together by lead 78 and also to one end of the first bridge coil 21 at terminal 31 by lead 34. A third set of three terminals 81, 82 and 83 is also provided by the third gang 80 of switch 200. Terminal 81 is connected by lead 43 to the ungrounded end of coil 23 at terminal 41. Terminal 83 is connected by lead 54 to one end of fingerboard coil 24 at terminal 51. Switch 200 also provides a fourth set of three terminals 91, 92 and 93 in the fourth gang 90. Terminal 91 is connected by lead 97 to terminal 82 in the third set of three terminals and also by lead 55 to terminal 52 which is connected in-between the two coils of the fingerboard pick-ups. Terminals 92 and 93 are connected together by lead 97. Switch 200 further has first, second, third and fourth connectors 64, 74, 84 and 94 which operate in synchronisation to connect one of the three terminals in each of the four gangs to a common pole 65, 75, 85 and 95 respectively. Pole 65 in the first gang 60 is connected via lead 67 to the third terminal 93 in the fourth gang 90.

A second switch 300 is also included in the switching apparatus of FIG. 2. Switch 300 is a two-gang five position switch. First gang 100 comprises three terminals 101, 102 and 103 which may be connected to a pole 104 by means of a wiper arm connector 106. The pole 104 of the first gang of the second switch 300 is connected permanently to ground terminal 105 via lead 107. Terminal 101 of the gang 100 is connected via lead 68 to the pole 65 of the first gang 60 of the first switch 200. The third terminal 103 of gang 100 is connected by lead 77 to the third terminal 73 of the second gang 70 in switch 200. There are no connections to the second terminal 102 of the first gang 100. The first terminal 111 of the second gang 110 of switch 300 is connected via lead 76 to the pole 75 of the second gang 70 of switch 200. The second terminal 112 is connected by lead 86 to the pole 85 of the third gang 80 of switch 200. The third terminal 113 is connected via lead 96 to the pole 95 of the fourth gang 90 of switch 200.

The pole 114 of the second gang 110 of switch 300 is connected to the output terminal 115 through lead 117. The output signal from this point may then be communicated through volume and tone controls 5,4 respectively on the guitar to an output jack for connection to an amplifier as is known in the art.

The wiper arm connector 106 of gang 100 is arranged to operate in synchronisation with the connector 116 of gang 110 of the second switch 300 and is able to contact either single or two adjacent terminal contacts of the three terminals in gang 100 as it is switched between its five positions. Therefore in a first position wiper arm 106 contacts terminal 101. In a second position the wiper arm 106 connects with terminals 101 and 102. In a third position only terminal 102 is selected. In a fourth position both terminals 102 and 103 are contacted and with the wiper arm in a fifth position only terminal 103 is contacted to the connector 106 and therefore to the pole 104. Wiper arm 116 operates in a corresponding manner to connect the terminals 111, 112 and 113 of the second gang 110 of switch 300 to the pole 114. Both wiper arms 106 and 116 move in tandem so that when connector 106 is in position 1 so is connector 116 and when connector 106 is in position 2 so is connector 116 and so on. The connections made by switch 200 when in its five positions are shown in Table 1 below:

TABLE I

| | Position of Switch 300 | | | | |
|---|---|---|---|---|---|
| | 1 | 2 | 3 | 4 | 5 |
| Pole 104 connected to terminal/s | 101 | (101 & 102) | 102 | (102 & 103) | 103 |
| Pole 114 connected to terminal/s | 111 | (111 & 112) | 112 | (112 & 113) | 113 |

In use switch 200 is used to select in which mode the guitar operates and may therefore be thought of as a mode select switch. With the switch in a first position the connectors 64,74,84,94 of the four gangs all connect a respective first terminal 61,71,81, 91 to a respective pole 65,75,85,95. This mode then allows the guitar to produce the tonal characteristics of a STRATOCASTER. A second mode of operation is entered when the switch 200 is in a second position so that the connectors of each of the four gangs connects with a respective second terminal 62,72,82,92. This mode of operation allows the guitar to produce the tonal characteristics of a "coil tapped" LES PAUL guitar similar to a TELECASTER guitar. In the third mode of operation, the connectors of switch 200 are all connected to the third respective terminal 63,73,83,93 in their respective gangs. In this mode the guitar can provide the tonal characteristics of a normal LES PAUL guitar. In each mode of operation the tone selection which is determined by which pickup coils are selected for operation at any one time, is made by the second switch 300 which may therefore be thought of as the tone select switch. These tone selections are shown in Table II where B indicates a bridge pickup coil, I the intermediate pickup coil and F indicates a fingerboard pickup coil. Pairs of coils will be in phase unless otherwise indicated.

TABLE II

| Position of Switch 300 | Position of Mode Switch 200 | | |
|---|---|---|---|
| | 1. STRATOCASTER | 2. COIL TAPPED LES PAUL | 3. LES PAUL |
| 1 | $B_{22}$ | $B_{21}$ | $(B_{21}$ & $B_{22})$ |
| 2 | $(B_{22}$ & $I_{23})$ | $(B_{21}$ & $F_{25})$ (out of phase) | $(B_{21}$ & $B_{22})$ & $(F_{24}$ & $F_{25})$ (out of phase) |
| 3 | $I_{23}$ | $F_{25}$ | $(F_{24}$ & $F_{25})$ |
| 4 | $(I_{23}$ & $F_{25})$ | $(F_{25}$ & $B_{21})$ | $(F_{24}$ & $F_{25})$ & $(B_{21}$ & $B_{22})$ |
| 5 | $F_{25}$ | $B_{21}$ | $(B_{21}$ & $B_{22})$ |

Thus, with switch 200 in a first position the connectors of each of the four gangs of switch 200 connect a first terminal 61,71,81 or 91 in the respective gang and the guitar operates in so-called mode 1.

By selecting one of the five positions in which the second switch 300 may be set the particular pickup coils which are connected so as to be operational may then be selected. For example with switch 300 in a first position a current path is formed from ground at terminal 105 along lead 107 to pole 104 through wiper arm 106 to terminal 101 and along lead 68 to pole 65 of the first gang 60 of switch 200, connector 64 of the first gang 60 is connected to a first terminal 61 in mode 1. Therefore the current path continues from terminal 61 through lead 35 to terminal 32 and through coil 22 to terminal 33 which is connected by lead 36 to terminal 63. Lead 66 connects terminal 63 to terminal 71 of the second gang of switch 200. In mode 1 terminal 71 is connected through connector 74 to pole 75 which is permanently connected to terminal 111 of the second gang of switch 300. Connection is then made through wiper arm 116 to pole 114 and to the output terminal 115 through lead 117. Therefore as Table 2 indicates with switch 200 in a first of three positions corresponding to mode 1 of three and with the second switch 300 in position 1, only bridge coil 22 is connected so as to be operational.

Similarly with the switch 300 in a second position one end of coil 22 is connected to ground through terminal 32 whilst the other end is connected through terminal 33 to the output terminal 115. In addition one end of intermediate coil 23 is connected from terminal 42 which is permanently grounded through the coil to terminal 41 and thereafter through gang 80 and gang 110 of the first and second switches respectively to the output terminal 115. Therefore with the switches in these positions bridge coil 22 and intermediate coil 23 are connected. With switch 300 in a third position only the intermediate coil 23 is connected from ground at terminal 42 through the coil to terminal 41 and thence through gang 80 and 110 to the output terminal 115. In position 4 the two wiper arms 106 and 116 of the two gang switch 300 both connect with two terminals 102,103 and 112,113 respectively. In this way fingerboard coil 25 is connected at one end to ground at terminal 53 and to the output terminal 115 through terminals 52,91,95 and 113. The intermediate coil 23 is also connected one end of the coil being grounded at terminal 45, the other end connected to output terminal 115 through terminals 41,81,85 and 112. In position 5 fingerboard coil 25 is connected through terminal 53 to ground and through terminals 52, 91, 95, 113 to the output terminal 115.

With switch 200 in a second position the guitar operates in so-called mode 2 to produce the tonal characteristics of a "coil tapped" LES PAUL guitar. When switch 300 is in a first position only bridge pickup coil 21 is connected between ground and output terminal 115. One end of the coil is connected through terminals 32,61,62,65 and 101 to ground. The other end of coil 21 is connected from terminal 31 to the output terminal 115 through terminals 73,72,75 and 111. When switch 300 is in a second position, pickup coils 21 and 25 are selected for operation. Bridge coil 21 is connected in the same way as with the switch 300 in position 1. Additionally fingerboard pickup coil 25 is connected at one end to ground via terminal 53 and to output terminal 115 through terminals 52,91,82,85 and 112. In this manner coils 21 and 25 are connected out of phase with each other due to each coil being wound in opposite senses as aforementioned. Operating a guitar in this manner with the pickup coils connected out of phase produces a characteristic tone sometimes desired by musicians. With switch 300 in a third position, coil 25 alone is connected for operation. One end of the coil is connected to terminal 53 and therefore to ground. The other end is connected through terminal 52 to the output terminal 115 via terminals 91,82,85 and 112. Position four of switch 300 connects both fingerboard coil 25 and bridge coil 21 between ground and output terminal 115. Coil 25 is connected in the same manner as with switch 300 in its third position. In addition one end of coil 21 is connected to ground terminal 105 through terminal 103, 73 and 31. The other end of coil 21 is connected to terminal 32 and to output terminal 115 through terminals 61,62,65,93, 92,95 and 113. It may be noted that this configuration of connected coils is the same as when the switch 300 is in its second position except that in this configuration coil 21 is connected in an opposite sense to coil 25 and therefore because of the coils being wound in an opposite sense the coils effectively operate in phase. When in a fifth position switch 300 connects only bridge pickup 21 for operation. One end of this coil is connected to ground terminal 105 through terminals 103, 73 and 31. The other end is connected to terminal 32 and output terminal 115 through terminal 61,62,65,93,92,95 and 113.

With the mode select switch 200 in its third position the guitar operates in so-called mode 3 and the pickups connected at any one time may be selected by the tone switch 300 to provide the tonal characteristics of a Les Paul guitar. When switch 300 is in a first position, both bridge coils 21 and 22 are connected so as to be operational. One end of coil 22 is connected to ground terminal 105 through terminals 104,65,63 and 33. The other end of coil 22 is connected to one end of coil 21 at terminal 32. The other end of coil 21 is connected to terminal 31 and to output terminal 115 through terminals 73,75 and 114. In this way bridge coils 21 and 22 operate as humbucker pickups. With switch 300 in a second position both bridge coils 21 and 22 are connected as described above with the switch in a first position. Additionally fingerboard pickup coils 24 and 25 are connected between ground and output terminal 115. One end of coil 25 is connected at terminal 53 to ground. The other end of coil 25 is connected to one end of coil 24 at terminal 52. The other end of coil 24 is connected to terminal 51 and from there to output terminal 115 through terminals 83,85 and 112. In this manner bridge coils 21 and 22 and fingerboard coils 24 and 25 are connected out of phase. By switching switch 300 to a third position, both fingerboard pickup coils are selected which operate in humbucker mode. Coil 25 is connected to ground at terminal 53 and to one end of coil 24 at terminal 52. The other end of coil 24 is connected to terminal 51 and to the output terminal 115 through terminals 83,85 and 112.

In a fourth position, switch 300 selects both bridge and fingerboard sets of humbucker pickups which operate in phase. The fingerboard pickups are connected in the same way as with the switch in a third position as described above. Bridge pickup coil 21 is connected at one end to terminal 31 and to ground terminal 105 through terminals 73 and 103. The other end of coil 21 is connected to one end of coil 22 at terminal 32. The other end of coil 22 is connected to terminal 33 and to output terminal 115 through terminals 63,65,93,95 and 113. When switch 300 is in a fifth position the two bridge pickup coils 21 and 22 are connected ready for operation. One end of coil 21 is connected to terminal 31 and to ground at terminal 105 through terminals 73 and 103. The other end is connected to one end of coil 22 at terminal 32. The other end of coil 22 is connected to terminal 33 and to output terminal 115 through terminals 63,65,93,95 and 113.

It can therefore be seen that in this example switching apparatus is provided which may be employed in an electric guitar having dual coil bridge humbucker pickups, dual coil fingerboard humbucker pickups and an intermediate single coil pickup wherein the switching apparatus controls which of the pickups are connected at any time thereby selecting the tonal characteristics which the guitar makes when played and wherein the switching apparatus includes selection circuitry which is operable to connect one or more coils from the selection of one coil alone, both coils of one dual coil pickup, both coils of both dual coil pickups and the intermediate pickup with one or more coils of the dual coil pickups. It may also be seen that the selection circuitry is operable to alter the direction of connection of the coils of at least one dual coil pickup in order to provide "in phase" and "out of phase" tonal characteristics.

The invention is not limited to the details of the foregoing example.

I claim:

1. An electric guitar comprising a dual coil bridge humbucker pickup, a dual coil fingerboard humbucker pickup, an intermediate pickup located between said bridge and fingerboard pickup, and switching apparatus having an output terminal and selection circuitry to selectively connect one or more coils of said pickups to the output terminal thereby selecting the tonal characteristics of the guitar when played, wherein said selection circuitry is operable to connect selectively one or more coils of said pickups to said output terminal to provide the tonal characteristics of a guitar with single coil pickups or a guitar with humbucker pickups, said selection circuitry being connected to at least one of said dual coil pickups to provide earth connections at interchangeable ends of each coil of said dual coil pickup whereby the selection circuitry is operable to provide "in phase" and "out of phase" tonal characteristics.

2. The electric guitar of claim 1 wherein said selection circuitry is operable to connect one or more coils from the selection of (1) one coil alone comprising either of the bridge pickup coils, the intermediate pickup coil or one of the fingerboard pickup coils, (2) both coils of one dual coil pickup, (3) both coils of both dual coil pickups, (4) the intermediate pickup with one coil of either of said dual coil pickups, and (5) one coil from each of the two dual coils.

3. The electric guitar of claim 1 wherein the selection circuitry comprises a first switching device connected to the dual coil bridge humbucker pickup, the single coil intermediate pickup and the dual coil fingerboard humbucker pickup and operable to elect a set of combinations of one or more pickups, a second switching device connected to the first switching device and to a common ground terminal and to the output terminal and operable to select one combination of one or more pickups from said selected set of combinations, whereby one or more pickups of said selected combination of pickups are thereby connected to said output terminal.

4. The electric guitar of claim 3 wherein the first switching device comprises a four-gang three-way switch and the second switching device comprises a two-gang five-way switch.

5. The electric guitar of claim 4 wherein the four-gang three-way switch further comprises a first set of first, second and third terminals wherein the first terminal thereof is connected to the second terminal thereof and to a terminal between the first and second coils of the dual coil bridge humbucker pickup and wherein the third terminal thereof is connected to an end of the second coil of the dual coil bridge humbucker pickup, a second set of first, second and third terminals whereby said first terminal thereof is connected to the third terminal of the first set of terminals and wherein the third terminal of said second set of terminals is connected to the second terminal thereof and to one end of the first coil of the dual coil bridge humbucker pickup, a third set of first, second and third terminals wherein said first terminal thereof is connected to one end of the single coil intermediate pickup and the third terminal thereof is connected to one end of a first coil of the dual coil fingerboard humbucker pickup, the fourth set of first, second and third terminals whereby said first terminal thereof is connected to the second terminal of the third set of terminals and is also connected to a terminal between the first and second coils of the dual coil fingerboard humbucker pickup and wherein the second and third terminals of the fourth set of terminals are connected together, a first pole connected to the third terminal of said fourth set of terminals and to a first connector which selectively connects said first pole to one of the first, second or third terminals of the first set of terminals, a second pole connected to a second connector which selectively connects said second pole of one of the first, second or third terminals of the second set of terminals, a third pole connected to a third connector which selectively connects said third pole to one of the first second or third terminals of the third set of terminals, a fourth pole connected to a fourth connector which selectively connects said fourth pole to one of the first, second or third terminals of the fourth set of terminals.

6. The electric guitar of claim 5 wherein the two-gang five-way switch further comprises a first set of first, second and third terminals wherein the first terminal thereof is connected to the first pole of the four-gang three-way switch and wherein the third terminal thereof is connected to the third terminal of the second set of terminals of the four-gang three-way switch, a second set of first, second and third terminals wherein the first, second and third terminals thereof are connected to the second, third and fourth poles respectively of the four-gang three-way switch, a first pole connected to a common ground terminal and to a first wiper arm connector which selectively connects said first pole to the first set of terminals of the two-gang five-way switch, a second pole connected to an output terminal and to a second wiper arm connector which selectively connects said second pole to the second set of terminals of the two-gang five-way switch.

7. Switching apparatus for an electric guitar comprising a dual coil bridge humbucker pickup, a dual coil fingerboard humbucker pickup, an intermediate pickup located between said bridge and fingerboard pickup, and switching apparatus having an output terminal and selection circuitry to selectively connect one or more coils of said pickups to the output terminal thereby selecting the tonal characteristics of the guitar when played, wherein said selection circuitry is operable to connect selectively one or more coils of said pickups to said output terminal to provide the tonal characteristics of a guitar with single coil pickups or a guitar with humbucker pickups, said selection circuitry being connected to at least one of said dual coil pickups to provide earth connections at interchangeable ends of each coil of said dual coil pickup whereby the selection circuitry is operable to provide "in phase" and "out of phase" tonal characteristics.

8. Switching apparatus of claim 7 in which said selection circuitry is operable to connect one or more coils from the selection of (1) one coil alone comprising either of the bridge pickup coils, the intermediate pickup coil or one of the fingerboard pickup coils, (2) both coils of one dual coil pickup, (3) both coils of both dual coil pickups (4) the intermediate pickup with one coil of said dual coil pickups, and (5) one coil from each of the two dual coils.

* * * * *